United States Patent [19]

Miura et al.

[11] 4,061,289

[45] Dec. 6, 1977

[54] WINDING MACHINE FOR ELECTRIC INDUCTIVE APPARATUS

[75] Inventors: Yoshio Miura; Kazuhiro Kobayashi; Masao Kotera, all of Hitachi, Japan

[73] Assignee: Hitachi, Ltd., Japan

[21] Appl. No.: 673,526

[22] Filed: Apr. 5, 1976

[30] Foreign Application Priority Data

Apr. 16, 1975 Japan ..... 50-45232

[51] Int. Cl.[2] ..... B65H 75/24; H01F 41/06

[52] U.S. Cl. ..... 242/7.13; 140/92.1; 242/72 R

[58] Field of Search ..... 242/7.09, 7.15, 7.16, 242/7.13, 53, 72 R; 140/92.1; 279/2

[56] References Cited

U.S. PATENT DOCUMENTS

| | | | |
|---|---|---|---|
| 1,093,284 | 4/1914 | Mehlum | 242/72 |
| 2,563,994 | 8/1951 | Dougherty | 242/72 X |
| 2,762,577 | 9/1956 | Herr | 242/72 |
| 2,941,743 | 6/1960 | Cochrane et al. | 242/72 |
| 3,166,104 | 1/1965 | Foley et al. | 140/92.2 |
| 3,866,847 | 2/1975 | Droll | 242/7.09 |

*Primary Examiner*—Billy S. Taylor
*Attorney, Agent, or Firm*—Craig & Antonelli

[57] ABSTRACT

The main body of the winding machine comprises: a rotating driving section and a support portion both mounted on a base; and a main shaft supported at one end thereof by a bearing mounted on said support portion and rotated in accordance with the rotation of the rotating driving section. The main shaft is detachably provided at one end thereof with a universal winding barrel comprising: a slider coupled on to the main shaft and sliding on the main shaft; and a plurality of winding barrel plates connected on to said slider through a plurality of links and changing the circumferential dimension to mount the insulating tube thereon when the slider slides axially on the main shaft. At the same time, the urging of the insulating tube against the plurality of winding barrel plates to support it and the releasing of said winding barrel plates are carried out automatically.

2 Claims, 8 Drawing Figures

WINDING MACHINE FOR ELECTRIC INDUCTIVE APPARATUS

BACKGROUND OF THE INVENTION

1. Field of the Invention

This invention relates to a winding machine for an electric inductive apparatus for forming a winding around an insulating tube of a transformer, a reactor or the like.

2. Description of the Prior Art

In general, an insulating tube formed of an insulating member such as a pressboard is used between an iron core and a winding wire or between the winding wires in an electric inductive apparatus such as a transformer. In order to form a winding around an insulating tube, a hollow cylindrical winding formed by winding a conductive wire around in a helical form is coupled on to an insulating tube, or an insulating tube is coupled on to a universal winding barrel of a winding device and a winding is formed by directly winding a conductive wire around the insulating tube.

However, by the former method, not only the process of coupling the cylindrical winding on to the insulating tube is needed but also this work is not easy, and hence it is advantageous to adopt the latter method.

By the latter method, a winding of the conductive wire around the insulating tube is required. In this case, sliding motions are caused between the outer surface of the winding barrel and the inner peripheral surface of the insulating tube and between the outer peripheral surface of the insulating tube and the winding due to the tensile force of the conductive wire acting on the insulating tube mounted on the winding barrel. To prevent these sliding motions, it is necessary to provide a firm contact between the winding barrel and the insulating tube. For this purpose, it is common that a radially opening and closing universal winding barrel is adopted as the winding barrel.

As shown in FIG. 1 and FIG. 2, in the conventional winding device, a universal winding barrel 3 is supported between the main body 1 of the winding machine and a stand 2. The universal winding barrel 3 comprises: a slider 5 mounted on the main shaft 4; a handle 6; a plurality of winding barrel plates 7 disposed at regular intervals in the circumferential direction; parallel links 8, 9 connecting the slider 5 to the winding barrel plates 7; and links 10 disposed symmetrically with said links 8, 9. The main shaft 4 is coupled at one end thereof to a driving shaft 11 of the main body 1 of the winding machine provided therein with a rotating driving section (not shown) by means of a coupler 12, supported at the other end thereof by bearings 13, 14 of the stand 2, and rotated by the rotating force of the driving shaft 11 in the direction of an arrow A.

A boss 6*a* of the handle 6 is threadably coupled to a threaded portion 15 at the end portion of the main shaft 4 on the side of the stand, and rotatably connected to the slider 5. Additionally, the slider 5 is mounted on a key 16 on the main shaft 4, and axially slides, being guided by the key 16. Consequently, when the handle 6 is rotated in the direction of an arrow 13*a*, the slider 5 slides axially in the direction of an arrow X, the link 8, 9 and 10 tiltingly move in accordance with the sliding of the slider 5, a plurality of the winding barrel plates 7 arranged in the circumferential direction are radially opened or closed, thus coming into a firm contact with the insulating tube 17 on the winding barrel plates 7 or being released therefrom.

However, the conventional winding device presents the following disadvantages.

1. When the insulating tube 17 is coupled on to the universal winding barrel 3, and the insulating tube 17 having formed the winding 18*b* is taken out, the universal winding barrel 3 should be removed from the main body 1 of the winding machine and the stand 2, thus requiring a large number of man-hours for this work.

2. The worker rotates the handle 6 to open or close the universal winding barrel 3, thereby providing a firm contact between the winding barrel plates 7 and the insulating tube 17. This work requires a great force. Hence, if the conductive wire 18*b* is wound round the insulating tube 17 without providing a full contact therebetween, such troubles frequently take place that the insulating tube 17 slips on the winding barrel plates 7 due to the tensile force of the conductive wire at the time of winding.

3. The arrangement of links on the universal winding barrel 3 consists of the links 8, 9 on the slider 5 and the links 10 on the main shaft 4, and when the winding barrel plates 7 are opened or closed, the links 10 tiltingly move about the fixed pin 19 on the main shaft 4 in the direction of an arrow *b*, then the winding barrel plates 7 are opened or closed in the direction of an arrow *d* and at the same time moved axially in the direction of an arrow *c*. Consequently, the change in inner diameter of the winding 18 results in the axial displacements of the winding barrel plates 7 with respect to the main shaft 4. Hence, it is difficult to fasten on to the main shaft a face plate or the like for receiving a pressure in the axial direction acting on the winding 18*b* at the time of the forming of the winding, and after all it becomes necessary to carry out such an inefficient work that the initial winding end of the winding 18*b* should be held by a vice 20.

SUMMARY OF THE INVENTION

One object of the present invention is to provide a winding machine for electric inductive apparatus wherein the main shaft projecting from one side of the main body of the winding machine is detachably provided at the other end thereof with a universal winding barrel so as to improve the winding efficiency.

Another object of the present invention is to provide a winding machine for an electric inductive apparatus wherein the circumferential dimension formed by a plurality of winding barrel plates constituting a universal winding barrel is changed so that the works of urging an insulating tube against the plurality of winding barrel plates to support it and of releasing said winding barrel plates can be performed automatically.

The winding machine according to the present invention comprises: the main body of the winding machine having a rotating driving section and a support portion both mounted on a base, a bearing mounted on the support portion and a main shaft supported at one end by said bearing and rotated in accordance with the rotation of said rotating driving section; and a universal winding barrel having a slider sliding on the main shaft in the axial direction of the main shaft, a plurality of winding barrel plates connected on to said slider through a plurality of links and changing the circumferential dimension through the agency of said links and an insulating tube mounted on said plurality of winding barrel plates due to the change of the circumferential dimension formed by said plurality of winding barrel plates. The main shaft whose one end is supported by said bearing is detachably provided at the other end thereof with said universal winding barrel. The mechanism for sliding said slider in the axial direction of the main shaft comprises: a rotating power source mounted at the other end portion of said main shaft; a transmission rod extending through said main shaft, connected at one end thereof to said rotating power source and rotated in accordance with the rotation of said rotating power source; a threaded portion formed at the other end of said transmission rod; and an end face of the slider threadably coupled to said threaded portion and sliding on the main shaft in the axial direction in accordance with the rotation of said transmission rod and the threaded portion. Consequently, when the rotating power source is driven, the transmission rod and the threaded portion are rotated to cause the end face of the slider to slide on the main shaft in the axial direction, whereby the plurality of winding barrel plates are opened or closed, thereby enabling to automatically carry out urging the insulating tube against the plurality of winding barrel plates to support it or carry out releasing said winding barrel plates.

DESCRIPTION OF THE PREFERRED EMBODIMENT

Figure 1:
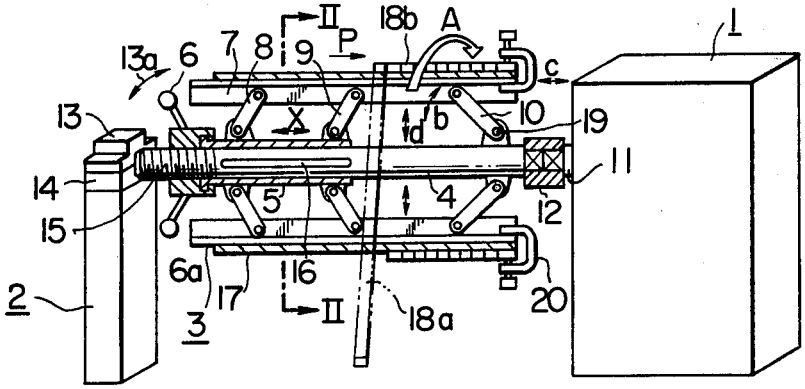
FIG. 1 PRIOR ART
FIG. 1 is a cross-sectional view roughly showing the conventional winding machine for an electric inductive apparatus.
Figure 2:
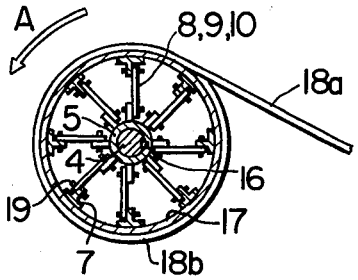
FIG. 2 PRIOR ART
FIG. 2 is a cross-sectional view taken along line II — II in FIG. 1.
Figure 3:
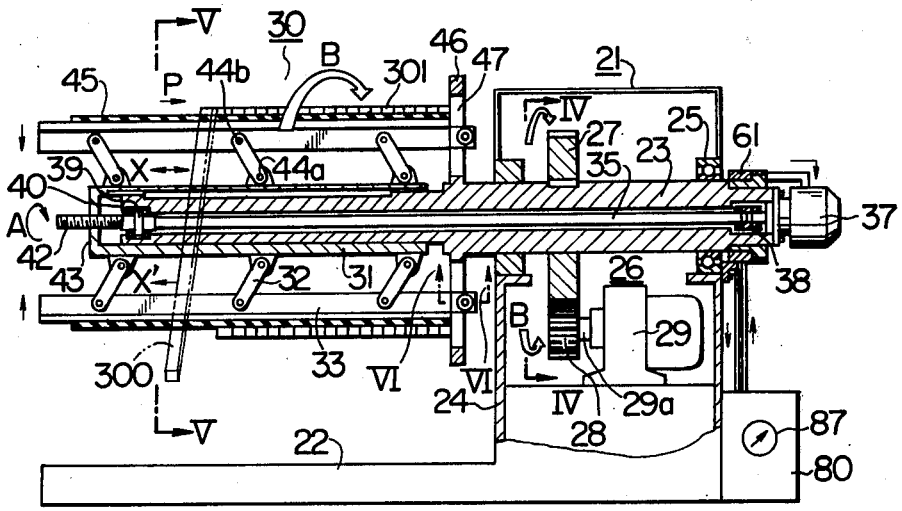
FIG. 3 is a cross-sectional view roughly showing the winding machine for the electric inductive apparatus embodying the present invention.

In the winding machine according to the present invention shown in FIG. 3, a universal winding barrel 30 is supported by the other end of the main shaft 23 horizontally extending from the main body 21 of the winding machine.

Figure 4:
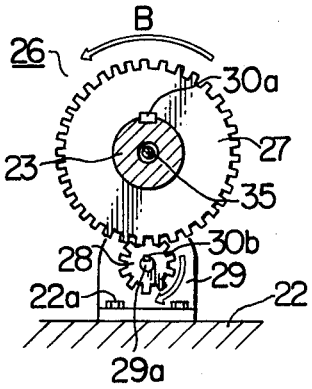
FIG. 4 is a cross-sectional view taken along line IV — IV in FIG. 3.

The main body 21 of the winding machine supports a support portion 24 of a base 22 thereof. The main shaft 23 supported by a bearing 25 mounted on the support portion 24 and extending horizontally is connected at one end thereof to a rotating driving section 26. Consequently, the main shaft 23 is rotated by the rotating driving section 26. As shown in detail in FIG. 4, the rotating driving section 26 is constructed such that the main shaft 23, a gear 27, a pinion 28 engaging the gear 27, and a shaft **29*a* of an electric motor 29 with a brake are connected to one another by means of keys 30*a* and 30*b*. The electric motor 29 with a brake is fixed on the base 22 by means of screws 22*a***.

The universal winding barrel 30 rotated along with the main shaft 23 comprises: a slider 31 coupled on to the other end of the main shaft 23; and a plurality of winding barrel plates 33 connected on to the slider through a plurality of links 32 and changing the circumferential dimension thereof when the slider 31 slides in the axial direction.

Figure 5:
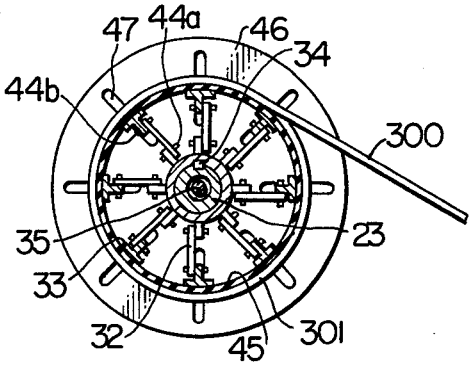
FIG. 5 is a cross-sectional view taken along line V — V in FIG. 3.

The slider 31 sliding on the other end of the main shaft 23 horizontally extending from the main body 21 of the winding machine transmits the rotating force of the main shaft 23 and at the same time connects the main shaft 23 to the slider 31 by means of a key 34 provided therebetween as shown in FIG. 5, thereby preventing the rotation in the circumferential direction. A transmission rod 35 extending through the holes of the main shaft 23 and the gear 27 is connected at one end thereof through a coupler 38 to a hydraulic motor 37 fastened to an end face of the main shaft 23 by means of a bolt 36 and a fixed plate **36*a* both shown in FIG. 7. The other end of the transmission rod 35 is rotatably, axially immovably guided in a bearing 40 formed on the inner wall surface of the main shaft 23 and disposed in a groove 39. A threaded portion 42 provided on an extension of the transmission rod 35 is threadably coupled to an end face 43 of the slider. Accordingly, when the threaded portion 42 is rotated, the end face 43** of the slider slides axially in the direction of an arrow X — X′ in accordance therewith.

A plurality of winding barrel plates 33 arranged at the regular intervals in the circumferential direction are connected to the slider 31 by means of the several parallel links 32, pins **44*a* and 44*b*, and when the slider 31 slides in the axial direction, the links 32 tiltingly move about the pins 44*a* in the radial direction, the circumferential dimension of the winding barrel plates 33 changes, or opens and closes in accordance therewith, thereby detachably mounting an insulating tube 45 on the winding barrel plates 33**.

Additionally, the ends of the winding barrel plates 33 facing the main body 21 of the winding machine engage a plurality of radial grooves 47 formed on a face plate 46 fixed on the main shaft 23. The dimension of each groove 47 is sufficient to accommodate the maximum length of circumferential dimension formed by the plurality of winding barrel plates, and the grooves have configurations elongate in the radial direction.

Figure 6:
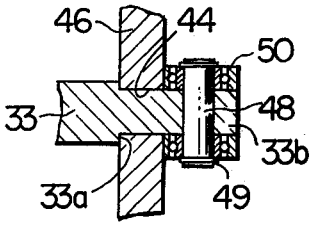
FIG. 6 is a cross-sectional view taken along line VI — VI in FIG. 3.

As shown in FIG. 6, the state of connection between the winding barrel plate 33 sliding in the groove 47 of the face plate 46 and the face plate 46 is such that the winding barrel plate 33 is formed at one end thereof with a projecting portion **33*b* having a width smaller than that of said plate 33 and contiguous to a step portion 33*a*, a roller bearing 50 is fastened to the forward end of said projecting portion 33*b* by means of a pin 48 and a stop 49, and the face plate 46 is clampingly held between the step portion 33*a* of said plate 33 and the roller bearing 50. Consequently, the winding barrel plates 33 are forcedly, slidably moved in the grooves 47 in the radial direction, being guided by the face plate 46, whereby the winding barrel plates 33** are radially opened or closed.

Figure 7:
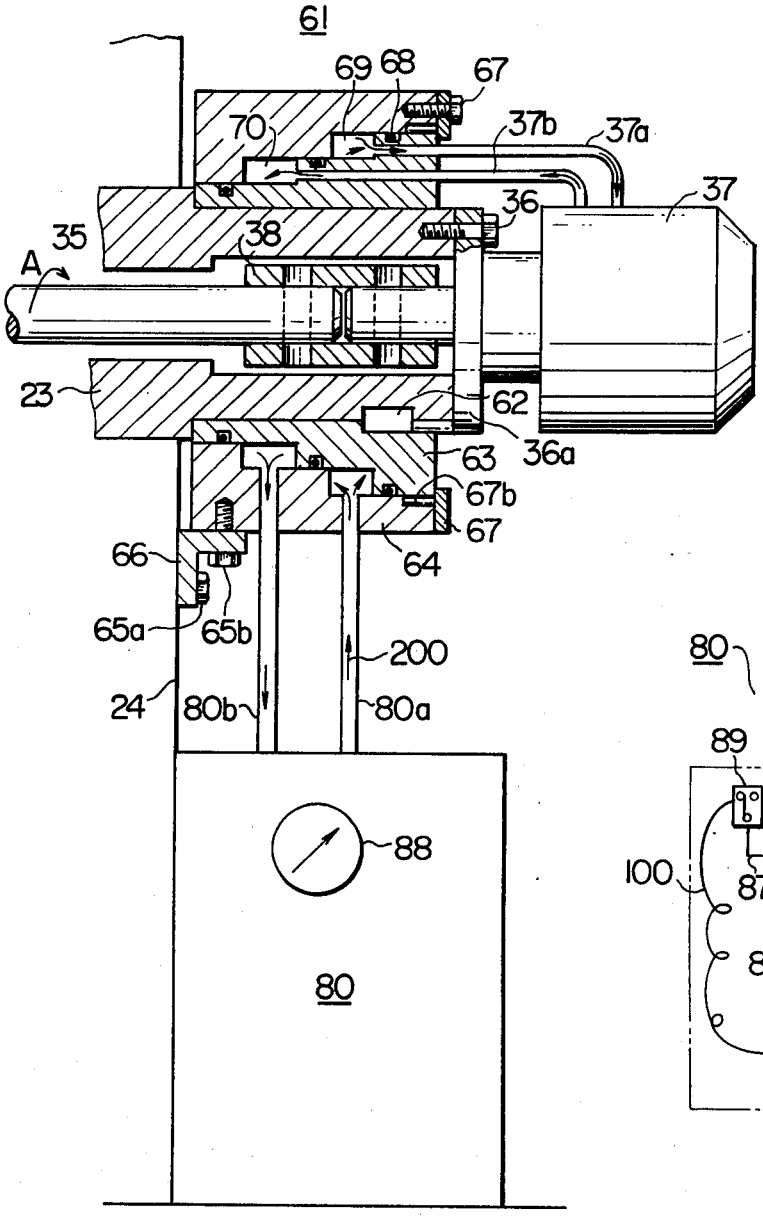
FIG. 7 is a cross-sectional view showing in detail the hydraulic slip ring illustrated in FIG. 3.

As shown in FIG. 7, a hydraulic slip ring 61 fastened to the end face of the main shaft 23 is maintained in communication with the hydraulic motor 37 and a hydraulic unit 80 through the respective two pipes **37*a*, 80*a* and 37*b*, 80*b* for supplying and discharging the control hydraulic pressures. A fixed portion 64 is inserted into a rotating portion 63 connected to the main shaft 23 by means of a key 62 and rotated in the same direction as the main shaft 23. The fixed portion 64 is supported at one end by a seat 66 secured at one end thereof to a support plate 24 and at the other end thereof to the fixed portion 64 by means of screws 65***a* and 65*b*. For securing a needle bearing 67*b* provided between the end portions of the rotating portion 63 and the fixed portion 64, a mounting plate 67 is fastened to the end face of the fixed portion 64 by means of a screw 67*a*.

The hydraulic motor 37 and the hydraulic unit 80 are connected to each other by two pipes 37*a*, 37*b* and 80*a*, 80*b* through first and second flow passages 69 and 70 formed in the mating surfaces between the rotating portion 63 and the fixed portion 64 in the circumferential direction. Additionally, a packing 68 for preventing oil leakage is interposed between both passages 69 and 70.

Figure 8:
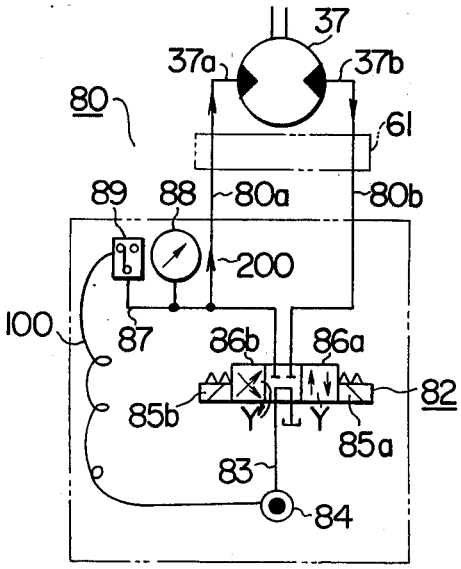
FIG. 8 shows the hydraulic circuit of the hydraulic unit illustrated in FIG. 3.

Description will be given of the arrangement of the hydraulic unit 80 with reference to the hydraulic circuit shown in FIG. 8. Namely, a directional control valve 82 controlling the hydraulic motor 37 is connected at one end to the pipes 80*a* and 80*b*, and at the other end to a hydraulic source 84 through a pipe 83, respectively.

To give the normal rotation to the hydraulic motor 37 by the directional control valve 82, one of the solenoids 85*a* is excited to supply the control hydraulic pressure 200 from the hydraulic source 84 in the direction of an arrow Y in a first control valve 86*a*, and the control hydraulic pressure is circulated through 80*a*, 61, 37*a*, 37 and 37*b*. Additionally, to give the opposite rotation to the hydraulic motor 37, the other of the solenoids 85*b* is excited to circulate the control hydraulic pressure 200 in the direction of an arrow Y' in a second control valve 86*b*, whereby the circulation opposite to the above route is effected, thus giving the opposite rotation to the hydraulic motor 37. In addition, a pressure gauge 88 and a pressure switch 80 both provided on a pipe 87 diverging from the intermediate portion of a pipe 80*a* function such that the pressure from the hydraulic source 84 is regulated by the pressure gauge 88 to the preset value and, when the pressure exceeds the preset value, the hydraulic source 84 is shut off by the pressure switch 89 connected to the hydraulic source 84 by a lead wire 100. As a result, damages of the insulating tube 45 can be prevented by the urging force of the winding barrel plates 33 in the radial direction.

Next, description will be given of the operation of the winding machine constructed as above.

Firstly, to urge the insulating tube 45 against the winding barrel plates 33 to support it, the universal winding barrel 30 is mounted on to the other end of the main shaft 23 whose one end is supported by the bearing 25. Thereafter, the insulating tube 45 is coupled on to the winding barrel plates 33 of the universal winding barrel 30. When one of the solenoids 85*a* is excited to operate the first control valve 86*a* in the direction of the arrow Y, the control hydraulic pressure 200 is supplied, discharged and circulated in the direction of the arrow through a pipe 80*a*, a first chamber 69, a pipe 37*a*, the hydraulic motor 37, a pipe 37*b* and the like, whereby the hydraulic motor 37 is rotated in the normal direction, the transmission rod 35 and the threaded portion 42 are rotated in the direction of the arrow A in accordance therewith, the slider 31 threadably coupled at the end face 43 thereof to the threaded portion 42 is guided on the main shaft 23 by the key 34 to slide axially in the direction of the arrow X. Then, the links 32 are turned about 44*a* as the fulcrums in the direction of *c*, and the winding barrel plates 33 urge and support the insulating tube 45. At this time, if the urging force of the winding barrel plates 33 exceeds the preset value, then the pressure switch 89 is actuated to interrupt the operation of the hydraulic source 84.

In this condition, the initial winding end of a conductive wire 300 is inserted in one point of the plurality of grooves 47, bent and fastened to a portion of the face plate 46. Thereafter, when the rotating driving section 26 is rotated in the direction of an arrow B, the main shaft 23, the universal winding barrel 30 and the rotating portion 63 are rotated in accordance therewith, whereby a conductive wire 300 is wound around the insulating tube 45 to form a winding 301. When the winding 301 is completed, the rotating driving section 26 is stopped.

To remove the insulating tube 45 having formed the winding 301 from the winding barrel plates 33, the other of the solenoids 85*b* is excited to operate the second control valve 86*b* in the direction of the arrow Y'. Then, the control hydraulic pressure 200 is circulated through a route opposite to the above, the hydraulic motor 37 is rotated in the opposite direction. Consequently, the transmission rod 35 and the threaded portion 42 thereof is rotated in the same direction as the hydraulic motor 37, the slider 31 threadably coupled at the end face 43 thereof to said threaded portion 42 slides on the main shaft 23, whereby the contact between the winding barrel plates 33 and the insulating tube 45 is released, thus making it possible to remove the insulating tube 45 from the winding barrel plates 33.

As described above, the following results can be achieved by the winding machine according to the present invention.

1. The universal winding barrel 30 and the insulating tube 45 can be freely mounted on and removed from the other end of the main shaft 23 whose one end is supported by the bearing 25 without any difficulty and hence the work of removing from and mounting on the main body of the winding machine the universal winding barrel, as has been carried out heretofore, can be dispensed with. As a result, the number of man-hours for mounting the insulating tube 45 on and removing it from the universal winding barrel 30 can be considerably decreased.

2. To urge the insulating tube 45 against the winding barrel plates 33 to support it and release said plates 33, the rotation of the hydraulic motor 37 rotates the transmission rod 35 and the threaded portion 42 thereof, and the slider 31 threadably coupled at the end face 43 thereof to said threaded portion slides in the axial direction, thereby making it possible to automatically carry out the operation of changing the circumferential dimension of the winding barrel plates 33. As a result, not only the work of urging the insulating tube 45 against the winding barrel plates 33 to support it and of releasing said plates 33 can be efficiently carried out but also the opening and closing of the universal winding barrel 30 is carried out by the hydraulic motor 37 and hence the opening and closing of the winding barrel plates 33 can be controlled by hydraulic pressure, thus precluding such trouble that at the time of forming a winding the insulating tube 45 is subjected to winding tension, slips on the winding barrel plates 33 and the winding 301 having been wound comes loose due to insufficient urging force between the winding barrel plates 33 and the insulating tube 45. Further, such trouble can be prevented that the insulating tube 45 is damaged due to an exceedingly strong urging force of the winding barrel plates 33.

3. The hydraulic motor 37 opening and closing the universal winding barrel 30 can be provided at one end of the main shaft on the opposite side of the universal winding barrel 30 by way of the main body 21 of the winding machine, whereby oil leaks from the hydraulic motor 37 or the hydraulic pipes 37*a*, 37*b* and 80*a*, 80*b* can be covered by the main body 21 of the winding machine, thereby making it possible to previously prevent a trouble of spoiling the winding.

4. When the main shaft 23 is rotated, the hydraulic motor also is rotated integrally therewith. However, the pipes 37*a*, 37*b* and 80*a*, 80*b* leading to the hydraulic motor 37 are separated by the hydraulic slip ring 61 into the sections of the rotating portion 63 and the sections of the fixed portion 64 and hence there is no danger of mutual clingings between the pipes 37*a*, 37*b* and 80*a*, 80*b* due to the rotations of the main shaft 23 and the hydraulic motor 37.

5. The face plate 46 of the universal winding barrel 30 serves as the guide for radially opening and closing the winding barrel plates 33 and at the same time can continuously receive the pressure loading P of the conductive wire 300 in the axial direction and hence the urging of the initial winding end by a vice or the like, as has been required heretofore, is no longer necessary.

In the above description, the hydraulic motor is used as the driving power source for opening and closing the universal winding barrel. However, the hydraulic motor can be replaced by an air motor, a direct current electric motor, an induction motor or the like provided it is a power source giving rotation to the transmission rod. For example, when a direct current electric motor is used, a brush is connected to the fixed portion and a commutator or the like to the rotating portion.

As has been described above, with the winding machine according to the present invention, the universal winding barrel can be detachably mounted on the other end of the main shaft whose one end is supported by the bearing of the main body of the winding machine, and the circumferential dimension of the plurality of winding barrel plates can be automatically changed, thereby making it possible to carry out these works extremely efficiently.

What is claimed is:

1. In a winding machine for forming an electrical inductive apparatus including a stationary support, a bearing mounted on said support, a main drive shaft supported at one end thereof by said bearing, and drive means for drivingly rotating said drive shaft, the improvement comprising a universal winding barrel having a slider mounted on said drive shaft for sliding in the axial direction of said shaft, a plurality of winding barrel plates disposed circumferentially around said shaft, a plurality of radially extending links pivotally connecting said slider to said plates, a rotating driving source mounted on the end of said drive shaft adjacent said bearing, a transmission rod extending through an axial bore in said drive shaft and beng connected at one end thereof to said rotating driving source so as to be rotated thereby, the other end of said transmission rod being in threaded engagement with the end of said slider so as to effect axial movement of said slider on said shaft as said transmission rod is rotated by said rotating driving source, and guide means for inhibiting axial movement of said plates while permitting radial movement thereof with respect to said drive shaft, said rotating driving source including a hydraulic motor, hydraulic slip ring means for supplying and discharging hydraulic fluid to said hydraulic motor comprising an inner annular rotating portion mounted on said drive shaft and an outer fixed annular portion coupled to said inner portion and mounted on said support, first and second flow passages being formed in the mating surfaces between said rotating and fixed portions, a source of hydraulic pressure, and at least two pipes connected from one of said flow passages to said hydraulic source through said fixed portion and from the other of said flow passages to said hydraulic motor through said rotating portion, respectively.

2. A winding machine as defined in claim 1, wherein said guide means comprises a disc fixed on said drive shaft and having a plurality of radially extending slots therein, one respective end portion of each of said winding barrel plates having a stepped portion of smaller width which extends through a respective slot in said disc, and a roller bearing being mounted on the end of each end portion for rolling contact with the face of said disc opposite said winding barrel plates.

* * * * *